US005345866A

United States Patent [19]

Reder et al.

[11] Patent Number: 5,345,866

[45] Date of Patent: Sep. 13, 1994

[54] DOCTOR BLADE BAR ASSEMBLY

[75] Inventors: Wolfgang O. Reder, Veitschöchheim; Georg Schneider, Würzburg, both of Fed. Rep. of Germany

[73] Assignee: Koenig & Bauer Aktiengesellschaft, Wurzburg, Fed. Rep. of Germany

[21] Appl. No.: 51,657

[22] Filed: Apr. 26, 1993

[30] Foreign Application Priority Data

Apr. 25, 1992 [DE] Fed. Rep. of Germany ..... 4213659

[51] Int. Cl.[5] ..... B41F 1/46

[52] U.S. Cl. ..... 101/363; 101/169; 101/350; 101/155; 118/413

[58] Field of Search ..... 101/155, 167, 169, 207, 101/208, 210, 350, 351, 363, 364, 365, 366, 148; 118/413, 259, 261, 262

[56] References Cited

U.S. PATENT DOCUMENTS

| | | | |
|---|---|---|---|
| 2,578,406 | 12/1951 | Dutro | 101/415.1 |
| 2,898,854 | 8/1959 | Crawford | 101/415.1 |
| 4,358,996 | 11/1982 | Ohlsson | 101/363 X |
| 4,556,307 | 12/1985 | Jensen | 118/261 X |
| 4,964,336 | 10/1990 | Bock et al. | 101/157 |
| 5,085,502 | 10/1991 | Köbler et al. | 101/363 |
| 5,152,220 | 10/1992 | Lindner et al. | 101/155 |
| 5,168,806 | 12/1992 | Reder et al. | 101/366 |
| 5,182,992 | 2/1993 | Rogge | 101/363 |
| 5,213,037 | 5/1993 | Leopardi, II | 101/366 X |

FOREIGN PATENT DOCUMENTS

| | | | |
|---|---|---|---|
| 0357825 | 9/1988 | European Pat. Off. . | |
| 2538908 | 9/1975 | Fed. Rep. of Germany . | |
| 3832216 | 9/1988 | Fed. Rep. of Germany . | |
| 4012825 | 10/1991 | Fed. Rep. of Germany | 101/363 |
| 3039342 | 2/1988 | Japan | 101/363 |
| WO8706528 | 11/1987 | PCT Int'l Appl. . | |
| 1306654 | 2/1973 | United Kingdom . | |

*Primary Examiner*—Edgar S. Burr
*Assistant Examiner*—Christopher A. Bennett
*Attorney, Agent, or Firm*—Jones, Tullar & Cooper

[57] ABSTRACT

A sector blade bar assembly supports spaced doctor blades on slidable base bodies which can be moved to throw-on or adjust the doctor blades with respect to a screened ink roller. A pair of blade base shifting devices are secured to doctor blade base support beams. The shifting devices utilize fluid actuated pistons to move the base bodies along guide surfaces on the beams. The doctor blades are moved in a linear manner to engage the screened ink roller at a negative contact angle. End plates on the base bodies are slidably supported and are spring biased into contact with the screened ink roller when the doctor blades are thrown onto the screened ink roller.

9 Claims, 2 Drawing Sheets

DOCTOR BLADE BAR ASSEMBLY

FIELD OF THE INVENTION

The present invention is directed generally to a doctor blade bar assembly. More particularly, the present invention is directed to a doctor blade bar assembly for a short inking unit. Most specifically, the present invention is directed to a doctor blade bar assembly for a short inking unit of a web fed rotary printing press. The doctor blade bar assembly is usable to bring spaced doctor blades of the short inking unit into contact with the surface of a screened ink roller or similar other roller in the printing press. Movement of doctor blade base bodies is in a direction such that the free ends of the doctor blades move toward or away from the surface of the screened ink roller along a straight line which extends in the direction of the plane of the doctor blades. End or closing plates, that cooperate with the doctor blades to define the ink chamber, are resiliently supported by the base bodies.

DESCRIPTION OF THE PRIOR ART

Short inking units for use in web-fed rotary printing presses are generally known in the prior art. In these short inking units, it is conventional to utilize two spaced, axially extending doctor blades, in conjunction with spaced end plates, to form an ink receptacle or chamber. Ink is placed in this chamber and free ends of the doctor blades are brought into contact with the surface of an ink roller, which is frequently a screened surface ink roller. In such short inking units it is typically necessary to be able to bring the doctor blades into and out of contact with the surface of the screened ink roller and to be able to adjust the position of the doctor blades as well as to replace them when they become excessively worn.

In one prior art device, as shown in German published unexamined patent application No. 38 38 546 there is shown a doctor blade assembly. In this device the doctor blades are insertable into slots and can be removed from these slots so that they can be quickly exchanged.

Another prior art assembly is shown in German published unexamined patent application No. 25 38 908. In this prior art device there is disclosed the resilient support of a fast wearing doctor blade for a gravure printing press. In this arrangement the doctor blade is positioned generally vertically to the periphery of the cylinder to be inked. This type of an arrangement would not be usable in a short inking unit as part of a chambered doctor blade assembly. In these short inking units, the spaced doctor blades engage the surface of the screened ink roller at a negative angle. If particularly thin, flexible doctor blades are brought into contact with the screened ink roller at a negative contact angle with an excessive amount of force during throw-on of the doctor blades or are bent as a result of an excessive preload, they will wear excessively. This excessive wear causes the doctor blades to have to be replaced too frequently and may also raise the greater question of whether the doctor blades can perform their function of being so-called stripping off blades.

It will thus be seen that a need exists for a doctor blade bar assembly which overcomes the limitations of the prior art devices. The doctor blade bar assembly in accordance with the present invention provides such a device and is a significant improvement over the prior art devices.

SUMMARY OF THE INVENTION

It is an object of the present invention to provide a doctor blade bar assembly.

Another object of the present invention is to provide a doctor blade bar assembly for a short inking unit.

A further object of the present invention is to provide a doctor blade bar assembly for a short inking unit of a web-fed rotary printing press.

Still another object of the present invention is to provide a doctor blade bar assembly in which the doctor blades and especially the stripping off doctor blade are arranged at a negative angle with respect to a screened ink roller.

Even a further object of the present invention is to provide a doctor blade bar assembly in which bending of the doctor blades during throwing-on of the short inking unit to the screened ink roller is avoided.

Still even another object of the present invention is to provide a doctor blade bar assembly in which the endurance of the doctor blades is increased.

As will be discussed in greater detail in the description of the preferred embodiment, which is set forth subsequently, the doctor blade bar assembly in accordance with the present invention utilizes doctor blade supporting base bodies which are slidably supported by doctor blade base support beams. These doctor blade base support beams also carry doctor blade base shifting devices which are actuable to move the base bodies to effect movement of the doctor blades into and out of contact with the screened ink roller. This movement of the base bodies by the base shifting devices is in a direction which moves the doctor blades toward and away from the screened ink roller in a straight line direction which is in the plane of the blades so that the blades engage the screened ink roller at a negative angle.

Several advantages are derived by the doctor blade bar assembly of the present invention. Since the doctor blades are moved during throw-on of the short inking unit in a straight line which lies on the plane of the blades, the blades are not bent or deformed. The elimination of such bending, which might otherwise occur as a result of a preload on the blades, greatly reduces blade wear. The doctor blade base shifting devices which move the base bodies on the blade base support beams are able to quickly readjust the positioning of the doctor blades. This also reduces wearing of the doctor blades and accordingly the endurance of the doctor blades is increased.

The end or closing plates which cooperate with the spaced doctor blades to define the ink receiving chamber, are resiliently supported in the base bodies at axial ends of the doctor blades. When the base bodies are moved toward the screened ink roller, the end plates will engage the ink roller without causing undue wear on the roller.

The doctor blade bar assembly in accordance with the present invention provides a device which overcomes the limitations of the prior art arrangements. The doctor blade bar assembly of the present invention is a substantial advance in the art.

BRIEF DESCRIPTION OF THE DRAWINGS

While the novel features of the doctor blade bar assembly in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
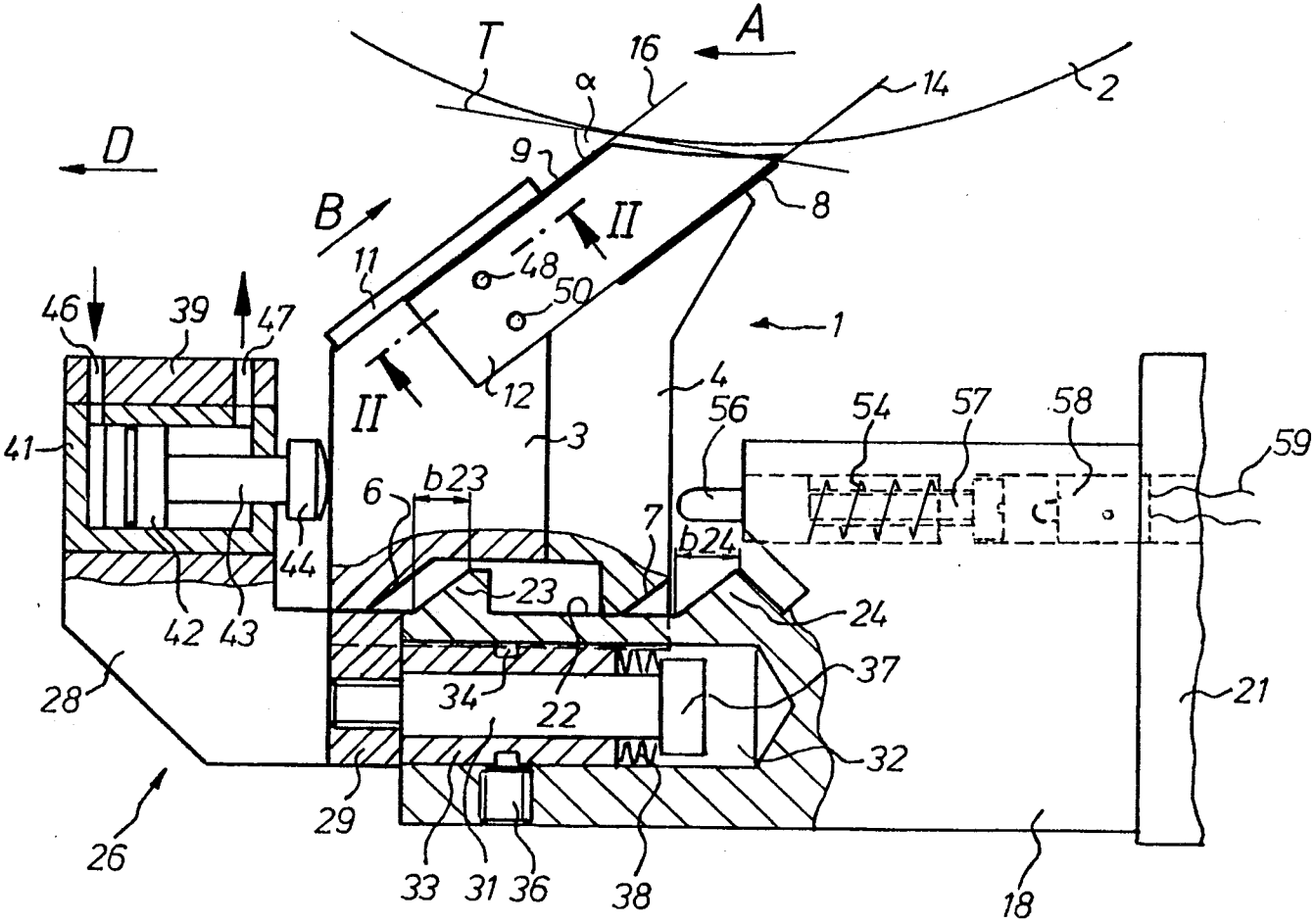
FIG. 1 is a side elevation view, partly in section of a doctor blade bar assembly in accordance with the present invention and showing the doctor blades in a thrown-off or rest position beneath a screened ink roller.

Referring initially primarily to FIG. 1, there may be seen generally at 1 a preferred embodiment of a doctor blade bar assembly in accordance with the present invention. The doctor blade bar assembly 1 is utilized as part of a short inking unit in a web-fed rotary press to supply printing ink to the surface of a screened ink roller which is depicted generally at 2 and which is rotatable in the direction indicated by the arrow A.

The doctor blade bar assembly 1 utilizes axially extending first and second base body members 3 and 4 to support first ends of spaced, axially extending, generally planar doctor blades 9 and 8. It will be understood that the first and second base body members 3 and 4, seen in FIG. 1, form a base body and support the first ends of the two parallel doctor blades 9 and 8, respectively. The first base body member 3 supports a stripping-off blade 9 by means of a doctor blade holder 11. This stripping-off blade 9 is used to remove ink from the surface of the screened ink roller 2. The second base body member 4 supports a sealing blade 8. This blade 8 is also removable from base body member 4.

As may be seen in FIG. 2, a first closing plate 12 is positioned in cooperation with the first ends of doctor blades 8 and 9 and is resiliently mounted on first base body member 3, as will be discussed in detail subsequently. It will be understood that another similar second closing or end plate 13 will be situated at the second end of the doctor blades 8 and 9. These two end or closing plates 12 and 13 cooperate with the spaced doctor blades 8 and 9 and the base body members 3 and 4 to form an ink chamber that is supplied with ink from an ink reservoir by an ink pump through a suitable flexible conduit. These elements are generally conventional and are not specifically shown in the drawings. The ink in the ink chamber formed by the doctor blades 8 and 9 and their associated end plates 12 and 13 is applied to the screened ink roller when the doctor blade bar assembly 1 of the present invention is utilized to throw-on or move the free ends of the doctor blades 8 and 9 and the free ends of the closing plates 12 and 13 into contact with the surface of the screened ink roller 1.

As may be seen in FIG. 1, the doctor blades 8 and 9 are moved toward or thrown-on to the screened ink roller 1 generally in the direction indicated by the arrow B. This direction of movement is generally along the lines 14 and 16 which are extensions of the planes of the doctor blades 8 and 9. The line 16 intersects a line T drawn tangent to the surface of the screened ink roller at the point of contact of the doctor blade 9 with the roller 2 at an angle $\alpha$ of approximately 40°–60°. It will be understood that the line 14 also intersects a similar tangent line at a similar angle of intersection. With reference to the direction of rotation of the screened ink roller 2, these angles of intersection are referred to as negative angles. It will be understood that typically four doctor blade bar assemblies 1 and their associated doctor blades are situated adjacent each other along the axial length of the screened ink roller 2. It will also be understood that another ink transfer roller could be utilized instead of screened ink transfer roller 2.

Figure 3:
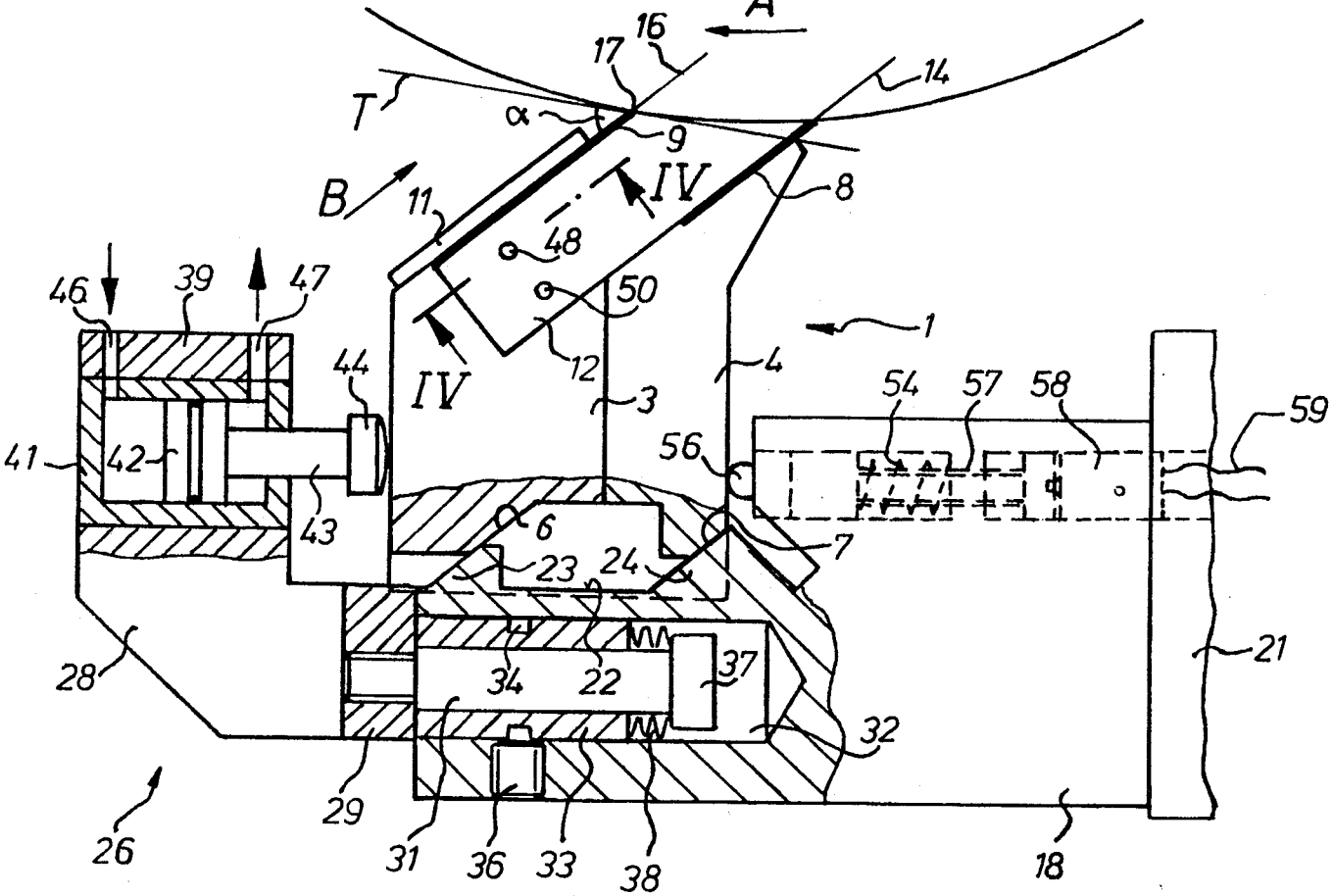
FIG. 3 is a view similar to FIG. 1 and showing the doctor blade bar assembly in a thrown-on or use position.

Referring again primarily to FIGS. 1 and 3, the doctor blade base body members 3 and 4 are slidably supported at either end of the axially extending doctor blades 8 and 9 by axially spaced first and second doctor blade base support beams 18 and 19. Only the base support beam 18 is seen in FIGS. 1 and 3 but it will be understood that a similar base support beam 19 is placed at the axially spaced second end of the doctor blades 8 and 9. Each doctor blade base support beam 18, 19 is secured at a first end to a tie bar 21 which is attached to the frame of the printing press. The beams 18 and 19 extend in cantilever fashion away from the tie bar 21 and beneath the screened ink roller 2. The support beams 18 and 19 are generally perpendicular to the axis of rotation of the screened ink roller 2. A sliding cooperation between the base body members 3 and 4 and each base support beam 18 or 19 is provided. The upper surface of each of the base support beams 18 or 19 is provided with a guide surface 22 upon which the base body members 3 and 4 are slidably supported for movement toward and away from the first end of the blade base support beams 18 and 19. First and second spaced, transverse ribs or cam surfaces 23 and 24 are formed on each blade base support beam 18 or 19. Both ribs or cam surfaces 23 and 24 have the same wedge-shaped cross section, the same height, and the same width "b" so that they both have the same angle of inclination. This angle of inclination is approximately 40°–60° and is the same as the angle $\alpha$ between the tangent line T and the lines of movement of the doctor blades 8 and 9 toward the peripheral surface of the screened ink roller 2.

Each of the base body members 3 and 4 has, as may be seen in FIGS. 1 and 3, a foot portion that includes an inclined transport area 6 or 7, respectively. It will be seen that these transport areas 6 and 7 have the same angle of inclination as do the cam surfaces on the ribs 23 and 24. Thus as the base body members 3 and 4 are moved to the right, as seen in FIGS. 1 and 3, or toward the first end of the blade base support beams 18 and 19, the transport areas 6 and 7 will engage the cam surfaces or ribs 23 and 24 and will cause the base body members 3 and 4, together with their associated doctor blades 9 and 8, respectively, to move along the lines 16 and 14 toward the peripheral surface of the screened ink roller 2.

The shifting of the pair of base body members 3 and 4 which form the base body towards the first end of the cantilever doctor blade base support beam 18 or 19 to thereby shift the doctor blades 8 and 9 toward the screened ink roller 2 is accomplished by a doctor blade bar throw-on and readjusting or blade base shifting assembly, generally at 26 or 27. As with previously discussed elements of the doctor blade bar assembly 1 of the present invention, it will be understood that only the blade base shifting assembly 26 used with the base body members 3 and 4 on the first doctor blade base support beam 18 is shown in FIGS. 1 and 3. The second blade base shifting assembly 27 that is used with the second, axially spaced doctor blade base support holding beam 19 is the same as assembly 26 but is not shown in the drawings.

Each of the blade base shifting assemblies 26 and 27 utilizes a generally L-shaped body 28. A first, lower end 29 of the body 28 is provided with a tapped bore hole that receives a threaded end of a set screw 31. This set screw 31 is positionable in a pocket bore hole 32 that is formed in a second, free, end of the doctor blade base support beam 18 with the pocket bore hole 32 extending generally parallel to the guide surface 22 of the beam 18. The set screw 31 carries an elongated sleeve 33 whose outer diameter corresponds to the inside diameter of the pocket borehole 32. The sleeve 33 has a circumferential groove 34 extending completely around it intermediate its ends. A clamping screw 36 is screwed into a threaded bore in the bottom portion of the beam 18 and an inner end of clamping screw 36 is receivable in the groove 34 to hold the sleeve 33 in the pocket bore hole 32. A plurality of cup springs or Belleville washers or the like, generally at 38, are placed between an inner end of sleeve 33 and an enlarged head 37 of the set screw 31. The threaded end of the set screw 31 is passed through the cup springs 38 and the sleeve 33 and is screwed into the threaded bore in the first end 29 of the L-shaped body 28 of the blade base shifting assembly 26. The sleeve 33 is then inserted into the pocket borehole 32 and is held so that it cannot move axially in borehole 32 by the clamp screw 36. It will be noted that the cup springs 38 allow some axial movement of the set screw 31 in the sleeve 33 and that the clamp screw 36 allows the sleeve 33 to turn while in the pocket bore 32.

A hydraulic or pneumatic cylinder 41 is located in a second, upper end of the generally L-shaped body 28 of the doctor blade base shifting assembly 26. A piston 43 is slidably supported in cylinder 41 and has a piston rod 43 which extends out of body 28 toward the base body member 3. An enlarged pressure piece 44 is attached to the free end 43 and physically contacts the surface of the base body member 3. The piston 42 is a double acting piston and fluid under pressure can be supplied to, or exhausted from the cylinder 41 on either side of piston 42 through suitable fluid inlets or outlets 46 and 47 that are formed in the second, upper end of the L-shaped body 28. These inlets and outlets 46 and 47 are connected through suitable conduits to a suitable fluid pressure generator through a suitable fluid pressure controller, which are not specifically depicted, so that an even, static pressure may be applied to the piston 42 in the cylinder 41.

Figure 2:
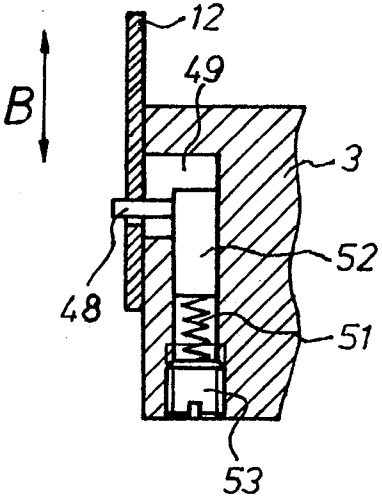
FIG. 2 is a cross-sectional view of a portion of one of the base bodies taken along line II—II in FIG. 1 and showing an end or closing plate in a rest position out of contact with the screened ink roller.
Figure 4:
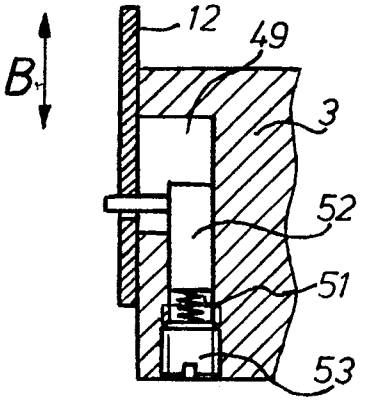
FIG. 4 is a view similar to FIG. 2 and showing the end plate in a use position in which it contacts the screened ink roller.

Turning now to FIGS. 2 and 4, it will be seen that the closing or end plates 12 are supported by the base body member 3 at the axially spaced ends of the doctor blades 8 and 9. Each end plate 12 has an aperture which receives an axially outwardly extending pin 48. The pin is attached to a slidable bolt 52 which is biased toward the screened ink roller 2 by a suitable spring 51 that is received in a channel 49 in the base body member 3 together with the bolt 52. A set screw 53 is used to close the bottom of the channel 49.

In operation, the doctor blade bar assembly, generally at 1 in accordance with the present invention, is usable to move the doctor blades 8 and 9 into, or out of engagement with the screened ink roller 2 and also to be removed. In removal of the doctor blades 8 and 9 to change or clean them, the L-shaped bodies 28 of the base shifting assembly 26 can be rotated through 90° by merely turning them since they will rotate with sleeves 33 turning in the pocket boreholes 32. The L-shaped bodies 28, once they have been rotated 90° will form a horizontal plane that is a continuation of the guide surfaces 22 of the doctor blade base support beams 18. The doctor blade base body members 3 and 4 can be slid out along this horizontal plane in the direction indicated by arrow D in FIG. 1. This rotation of the L-shaped body 28 provides a convenient support that requires only a small amount of space but which is all that is needed to accomplish throwing-off the doctor blade support bar body members 3 and 4 or for handling of the doctor blades.

When it is necessary to move the doctor blade base body members 3 and 4 and hence their associated doctor blades 9 and 8, respectively from their rest position shown in FIG. 1 to their thrown-on or working position shown in FIG. 3, the inlet 46 of the cylinder 41 in the second, upper end of the L-shaped body 28 of the blade base shifting assembly 26 is provided with a pressure medium through a suitable regulating device. This shifts the piston 42 to the right, as seen in FIG. 1, and causes the piston rod 43 to move the pressure piece 44 into contact with the base body member 3. The base body member 3 and its associated base body member 4 move to the right along support surface 22 until their transport areas 6 and 7 contact the cam surfaces or slopes on the ribs 23 and 24. The base body members 3 and 4 then move upwardly and to the right in the direction indicated by the arrow B in FIGS. 1 and 3 so that the doctor blades 8 and 9 move along lines 14 and 16 into their points of contact with the screened ink roller 2. This thrown-on position is shown in FIG. 3.

The doctor blades 8 and 9 are pressed against the peripheral surface of the screened ink roller 2 by the maintenance of a contact pressure on the piston 42 through the fluid inlet line 46. This contact pressure is selected so that the free, second, doctoring ends or edges of the doctor blades 8 and 9 will be evenly pressed against the roller 2 but will not be bent or deformed. Thus the proper contact angle between the blades 8 and 9 and the screened ink roller 2 will be maintained. The end or closing plates 12 will also engage the surface of the screened ink roller 2 with the proper biasing force being provided by springs 51, sliding bolts 52 and pins 48.

Referring again to FIGS. 1 and 3, a borehole may be formed in each of the doctor blade base support beams 18 and 19 with this borehole being generally parallel to the pocket borehole 32 and extending from the first end of each of the beams 18 and 19 to a point adjacent the base body member 4. A pressure piece 56 is supported in this borehole and extends out from the beam toward the base body member 4. A spring 54 is utilized in the borehole to bias the pressure piece 56 out of the beam. As may be seen in FIG. 3, when the blade base shifting assembly 26 is used to move the base body members 3 and 4 to the right to thereby engage the free ends of the doctor blades 9 and 8, respectively, with the surface of the screened ink roller 2, the pressure piece 56 will be forced into its borehole by the base body member 4 and will engage a suitable limit switch 57. The limit switch 57, in turn engages a contact piece 58 which is connected through suitable wires or cables 59 with the ink pump that will supply ink to the ink chamber defined by the doctor blades 8 and 9, the base body members 3 and 4, and the end or closing plates 12 and 13. Thus when the doctor blade bar assembly 1 is in the position shown in FIG. 3, the depression of the contact piece 58 will cause ink to be delivered to the ink chamber. When the doctor blade bar assembly 1 is in the thrown-off position shown in FIG. 1, the ink pump will be deactivated and no ink will be supplied to the ink chamber.

In the doctor blade bar assembly of the present invention, it will be understood that the support feet of the base body members 3 and 4 may have transport areas 6 and 7 that extend axially beneath the doctor blade bar assembly 1 the length of the doctor blades 8 and 9. While a preferred embodiment of a doctor blade support bar assembly in accordance with the present invention has been set forth fully and completely hereinabove, it will be understood that various changes in, for example the overall size of the screened ink roller, the type of ink pump or ink supply conduits used, the specific pressurized fluid and the like can be made without departing from the true spirit and scope of the present invention which is accordingly to be limited only by the following claims.

What is claimed is:

1. A doctor blade bar assembly for a short inking unit of a web-fed rotary printing press having a screened ink roller, said doctor blade bar assembly comprising:

a screened ink roller having a surface and being supported for rotation about an axis of rotation in a first direction;

a doctor blade base body supported for sliding movement with respect to said screened ink roller;

first and second spaced, generally planar doctor blades supported at first ends by said doctor blade base body, said first and second doctor blades each having a doctoring edge which is engageable with said surface of said screened ink roller;

doctor blade base support means for supporting said doctor blade base body for sliding movement; and means to move said doctor blade base body to shift said first and second doctor blades along first and second straight lines defined by said planar first and second doctor blades into contact with said surface of said screened ink roller at a negative contact angle.

2. The doctor blade bar assembly of claim 1 wherein said first and second doctor blades are supported in said doctor blade base body at an angle of 40° to 60° to a line tangent to said surface of said screened ink roller at a point of contact of said doctoring edges of said doctor blades with said screened ink roller.

3. The doctor blade bar assembly of claim 1 wherein said doctor blade base support means includes spaced first and second doctor blade base support beams having first and second spaced wedge-shaped ribs and further wherein said doctor blade base body has transport areas, said transport areas being engageable with said first and second spaced wedge-shaped ribs on said first and second doctor blade base support beams.

4. The doctor blade bar assembly of claim 1 further including end plates resiliently supported on said doctor blade base body at spaced ends of said first and second doctor blades and wherein said doctor blade base body has spring biased sliding bolts with pins, said end plates being resiliently supported on said doctor blade base body by said pins carried by said spring biased sliding bolts in said base body.

5. The doctor blade bar assembly of claim 3 wherein said first and second spaced ribs each have the same height, width, and angle of inclination.

6. The doctor blade bar assembly of claim 1 wherein said means to move said doctor blade base body includes a blade base shifting assembly secured to said doctor blade base support means.

7. The doctor blade bar assembly of claim 6 wherein said blade base shifting assembly includes an L-shaped body having a lower end which is rotatably supported in said doctor blade base support means.

8. The doctor blade bar assembly of claim 7 wherein said L-shaped body has an upper end which includes a fluid actuated piston with a piston rod, and a cylinder, said piston rod of said piston being engageable with said doctor blade base body.

9. A doctor blade bar assembly for a short inking unit of a web-fed rotary printing press having a screened ink roller, said doctor blade bar assembly comprising:

a screened ink roller having a surface and being supported for rotation about an axis of rotation in a first direction;

a doctor blade base body;

first and second generally planar spaced doctor blades supported at first ends by said doctor blade base body, said first and second doctor blades each having a doctoring edge which is engageable with said surface of said screened ink roller, said first and second doctor blades extending from said doctor blade base body toward said surface of said screened ink roller along first and second straight lines defined by planes of said first and second planar doctor blades, said first and second straight lines intersecting said surface of said screened ink roller at first and second points of contact at first and second tangent lines at said first and second points of contact;

first and second spaced doctor blade base support beams for supporting said doctor blade base body for sliding movement; and means to move said doctor blade base body to shift said first and second doctor blades along said first and second straight lines into contact with said surface of said screened ink roller at said first and second negative contact angles.

* * * * *

UNITED STATES PATENT AND TRADEMARK OFFICE

CERTIFICATE OF CORRECTION

PATENT NO. : 5,345,866

DATED : September 13, 1994

INVENTOR(S) : Reder et al.

It is certified that error appears in the above-identified patent and that said Letters Patent is hereby corrected as shown below:

Column 8, Claim 9, line 48, after "second" (first occurrence) insert -

--negative contact angles with respect to first and second--. -

Signed and Sealed this

Twenty-second Day of November, 1994

*Attest:*

Bruce Lehman

BRUCE LEHMAN

*Attesting Officer*

*Commissioner of Patents and Trademarks*